US011053038B2

(12) United States Patent
Tiffany et al.

(10) Patent No.: US 11,053,038 B2
(45) Date of Patent: Jul. 6, 2021

(54) PACKAGING APPARATUSES AND SYSTEMS

(71) Applicant: The Boeing Company, Chicago, IL (US)

(72) Inventors: Todd S. Tiffany, Northbend, WA (US); Tristan E. Lee, Seattle, WA (US)

(73) Assignee: The Boeing Company, Chicago, IL (US)

( * ) Notice: Subject to any disclaimer, the term of this patent is extended or adjusted under 35 U.S.C. 154(b) by 181 days.

(21) Appl. No.: 16/284,865

(22) Filed: Feb. 25, 2019

(65) Prior Publication Data

US 2019/0256235 A1 Aug. 22, 2019

Related U.S. Application Data

(62) Division of application No. 14/505,217, filed on Oct. 2, 2014, now Pat. No. 10,232,968.

(51) Int. Cl.

| | |
|---|---|
| ***B65B 67/12*** | (2006.01) |
| ***B65B 35/22*** | (2006.01) |
| ***B65B 51/14*** | (2006.01) |
| ***B65B 19/34*** | (2006.01) |
| ***B65B 9/13*** | (2006.01) |

(52) U.S. Cl.

CPC ..... *B65B 35/22* (2013.01); *B65B 9/13* (2013.01); *B65B 19/34* (2013.01); *B65B 51/14* (2013.01)

(58) Field of Classification Search

CPC ..... B65B 9/13; B65B 19/34; B65B 51/14; B65B 35/10; B65B 35/22; B65B 9/10; B65B 67/12

USPC ..... 53/64

See application file for complete search history.

(56) References Cited

U.S. PATENT DOCUMENTS

| | | | | |
|---|---|---|---|---|
| 2,764,862 | A | 1/1953 | Rado | |
| 2,958,169 | A | 11/1960 | Valer | |
| 3,629,987 | A | 12/1971 | Klopfenstein | |
| 3,650,298 | A | 3/1972 | Delmar | |
| 3,662,514 | A | 5/1972 | Goss | |
| 3,797,105 | A | 3/1974 | Arnold | |
| 3,839,842 | A | 10/1974 | Kobayashi | |
| 3,908,335 | A | 9/1975 | Giannelli | |
| 3,975,795 | A | 8/1976 | Kupcikevicius | |
| 3,994,116 | A * | 11/1976 | McCormick | B65B 9/026 53/418 |
| 4,004,400 | A | 1/1977 | Anderson | |
| 4,015,021 | A | 3/1977 | Harima | |
| 4,045,946 | A * | 9/1977 | Schaefer | B65B 9/2028 53/550 |
| 4,091,595 | A | 5/1978 | Pelster | |
| 4,107,903 | A | 8/1978 | Wickersheim | |

(Continued)

OTHER PUBLICATIONS

Produce Bags, https://www.swmintl.com/markets/beverage-and-packaging/produce-bags, accessed Jul. 12, 2018.

*Primary Examiner* — Gloria R Weeks

(74) *Attorney, Agent, or Firm* — Kunzler Bean & Adamson

(57) ABSTRACT

A packaging apparatus comprising a base surface, in turn comprising a first end and a second end is disclosed. The packaging apparatus further comprises a feed tube between the first end and the second end of the base surface, a transporter between the first end of the base surface and the feed tube, a first sealer between the feed tube and the second end of the base surface, and a second sealer between the first sealer and the second end of the base surface.

20 Claims, 12 Drawing Sheets

(56) References Cited

U.S. PATENT DOCUMENTS 4,363,205 A 12/1982 Hollander
4,385,478 A * 5/1983 Veerkamp ..... B65B 43/123 53/118
4,479,283 A 10/1984 Hollingsworth et al.
4,543,769 A 10/1985 Schmitz
4,570,301 A 2/1986 Beckman
4,577,370 A 3/1986 Kollross
4,590,748 A 5/1986 Harrison
4,730,367 A 3/1988 Vinoku
4,974,391 A * 12/1990 Blum ..... B65B 5/068 53/69
5,009,058 A 4/1991 Ptaschek
5,024,042 A 6/1991 Meyer
5,085,036 A * 2/1992 Evans ..... B29C 53/50 493/302
5,211,599 A 5/1993 Stanley
5,226,269 A * 7/1993 Stoltenberg ..... B65B 39/04 53/433
5,273,482 A 12/1993 Beckman
5,392,591 A 2/1995 Simpson
5,566,526 A 10/1996 Suga
5,570,569 A 11/1996 Masuda
5,605,502 A 2/1997 Christensen
5,685,129 A * 11/1997 Baker ..... B65B 7/10 53/254
5,799,467 A 9/1998 Nankervis
5,803,801 A 9/1998 Vrijsen
5,834,660 A 11/1998 Whalen
6,270,821 B1 * 8/2001 Grip ..... B65D 75/545 383/40
6,305,151 B1 10/2001 Schoenegg
6,470,653 B1 * 10/2002 Lutz ..... B65B 1/24 53/136.1
6,539,691 B2 4/2003 Beer
6,662,527 B1 12/2003 Suga
6,718,735 B2 4/2004 Lewis
6,797,105 B1 * 9/2004 Schumann ..... B29C 66/8432 156/282
6,889,487 B2 5/2005 Suga
7,013,625 B2 * 3/2006 Curies ..... B65B 43/267 53/261
7,124,553 B2 10/2006 Norton
7,308,780 B2 * 12/2007 Rimondi ..... B29C 65/10 53/373.8
7,662,029 B2 2/2010 Arias
7,908,826 B2 3/2011 Reaves
7,950,203 B2 5/2011 Gray
7,987,651 B2 * 8/2011 Beeland ..... B65B 27/125 53/284
8,371,909 B2 2/2013 Lowder
9,139,318 B2 9/2015 Lee
9,828,127 B2 * 11/2017 Shaker ..... B65B 7/02
10,011,377 B2 * 7/2018 Oyama ..... B65B 39/02
10,011,380 B2 7/2018 Lowder
2003/0000179 A1 1/2003 Nakagawa
2007/0095020 A1 * 5/2007 Oriol Torrents ..... B65B 1/02 53/450
2008/0092491 A1 4/2008 Kinoshita
2011/0036055 A1 * 2/2011 Shibagaki ..... B65B 35/44 53/266.1

* cited by examiner

PACKAGING APPARATUSES AND SYSTEMS

BACKGROUND

Bulky components, such as airplane stringers, are commonly packaged, e.g., for transportation purposes. The packaging is manually applied to the components. Such conventional packaging techniques are slow and cumbersome. Additionally, the necessary manual manipulations of the components increase the risk of damage to the components.

SUMMARY

Accordingly, apparatuses and methods, intended to address the above-identified concerns, would find utility.

The following is a non-exhaustive list of examples, which may or may not be claimed, of the subject matter according the present disclosure.

One example of the present disclosure relates to a packaging apparatus comprising a base surface, in turn comprising a first end and a second end. The packaging apparatus further comprises a feed tube between the first end and the second end of the base surface, a transporter between the first end of the base surface and the feed tube, a first sealer between the feed tube and the second end of the base surface, and a second sealer between the first sealer and the second end of the base surface.

Another example of the present disclosure relates to a packaging system comprising a base surface, in turn comprising a first end and a second end. The packaging system further comprises a feed tube between the first end and the second end of the base surface, and a transporter between the first end of the base surface and the feed tube. Additionally, the packaging system comprises a first sealer between the feed tube and the second end of the base surface, and a second sealer between the first sealer and the second end of the base surface. The packaging system also comprises a position sensor between the first sealer and the second sealer and a robotic arm, operatively coupled with the position sensor.

Yet another example of the present disclosure relates to a packaging method comprising coupling an open end of a sleeve to a feed tube; advancing a component through the feed tube until the component is entirely within the sleeve; and sealing the sleeve from the open end.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of a packaging system, according to one or more examples of the present disclosure;

FIG. 2 is a perspective view of the packaging system of FIG. 1, according to one or more examples of the present disclosure;

FIG. 3 is a perspective view of a packaging apparatus illustrated in FIG. 1, according to one or more examples of the present disclosure;

FIG. 4 is a perspective view of a portion of the packaging apparatus of FIG. 1, according to one or more examples of the present disclosure;

FIG. 5 is a perspective view of an end cap associated with the packaging apparatus of FIG. 1, according to one or more examples of the present disclosure;

FIG. 6 is a side elevational view of the packaging apparatus of FIG. 1, according to one or more examples of the present disclosure;

FIG. 7 is a side elevational view of the packaging apparatus of FIG. 1, according to one or more examples of the present disclosure;

FIG. 8 is a side elevational view of the packaging apparatus of FIG. 1, according to one or more examples of the present disclosure;

FIG. 9 is a perspective view of a packaging apparatus of FIG. 1, according to one or more examples of the present disclosure;

FIG. 10 is a block diagram of a packaging method according to one or more examples of the present disclosure;

FIG. 11 is a block diagram of aircraft production and service methodology; and FIG. 12 is a schematic illustration of an aircraft.

DETAILED DESCRIPTION

Figure 1:
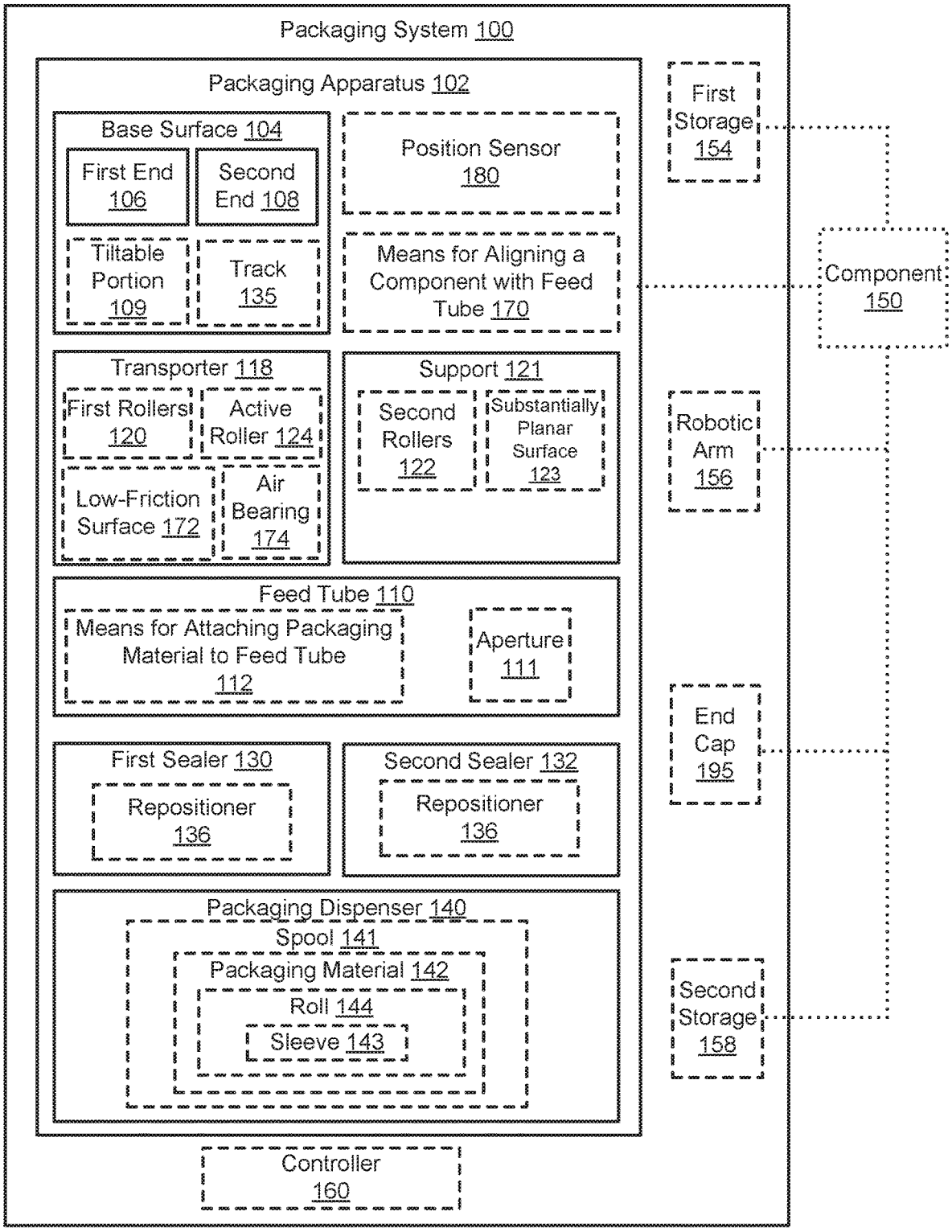

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships between the various disclosed elements are necessarily represented. Accordingly, couplings other than those depicted in the block diagrams may also exist. Dashed lines, if any, connecting the various elements and/or components represent couplings similar in function and purpose to those represented by solid lines; however, couplings represented by the dashed lines may either be selectively provided or may relate to alternative or optional examples of the present disclosure. Likewise, elements and/or components, if any, represented with dashed lines, indicate alternative or optional examples of the present disclosure. Environmental elements, if any, are represented with dotted lines. Virtual imaginary elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

Figure 10:
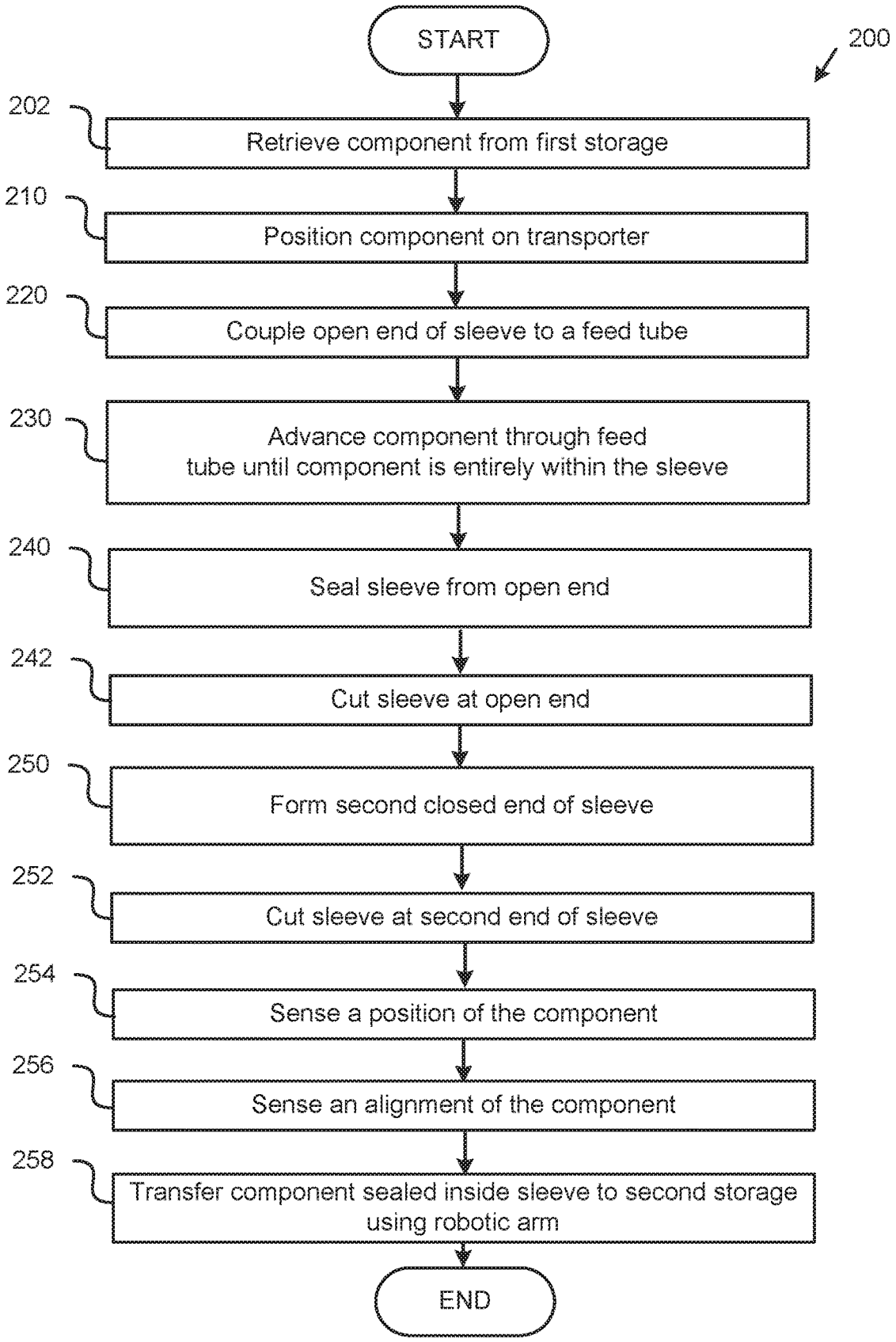

In FIGS. 1 and 10, referred to above, the blocks may represent operations and/or portions thereof and lines connecting the various blocks do not imply any particular order or dependency of the operations or portions thereof. FIGS. 1 and 10 and the accompanying disclosure describing the operations of the methods set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, any means-plus-function clauseis to be interpreted under 35 U.S.C. 112(f), unless otherwise explicitly stated. It should be noted that examples provided herein of any structure, material, or act in support of any means-plus-function clause, and equivalents thereof, may be utilized individually or in combination. Thus, while various structures, materials, or acts may be described in connection with a means-plus-function clause, any combination thereof or of their equivalents is contemplated in support of such means-plus-function clause.

Illustrative, non-exhaustive examples, which may or may not be claimed, of the subject matter according the present disclosure are provided below.

Referring, e.g., to FIGS. 1-4 and 6-9, the instant paragraph pertains to example 1 of the present disclosure. Example 1 relates to packaging apparatus 102. According to example 1, packaging apparatus 102 comprises base surface 104, in turn comprising first end 106 and second end 108. Packaging apparatus 102 further comprises feed tube 110 between first end 106 and second end 108 of base surface 104, transporter 118 between first end 106 of base surface 104 and feed tube 110, first sealer 130 between feed tube 110 and second end 108 of base surface 104, and second sealer 132 between first sealer 130 and second end 108 of base surface 104.

Packaging apparatus 102 facilitates ease in packaging component 150 within a sleeve and sealing the component within the sleeve. Without packaging apparatus 102, components are difficult to insert into a sleeve and seal within the sleeve, as a user would be required to concurrently lift the component while manually manipulating the sleeve about the component. Feed tube 110 of packaging apparatus 102 secures a sleeve in place in a manner that facilitates ease in insertion of the component into the sleeve.

Referring generally to FIG. 1, and particularly to, e.g., FIGS. 3, 4, and 6-9, the instant paragraph pertains to example 2 of the present disclosure. According to example 2, which includes the subject matter of example 1, above, packaging apparatus 102 further comprises packaging dispenser 140 at second end 108.

Packaging dispenser 140 enables efficient access to packaging material 142. A user can easily dispense packaging material as needed using packaging dispenser 140.

Referring generally to FIG. 1, and particularly to, e.g., FIGS. 3, 4, and 6-9, the instant paragraph pertains to example 3 of the present disclosure. According to example 3, which includes the subject matter of example 2, above, packaging dispenser 140 is configured to dispense at least one sleeve 143.

At least one sleeve 143 enables packaging material to surround an entirely of component 150. Packaging dispenser 140 enables efficient access to a supply of at least one sleeve 143. Alternatively, in some examples, at least one sleeve 143 can be a plurality of preformed sleeves each having an open end and a preformed closed end.

Figure 6:
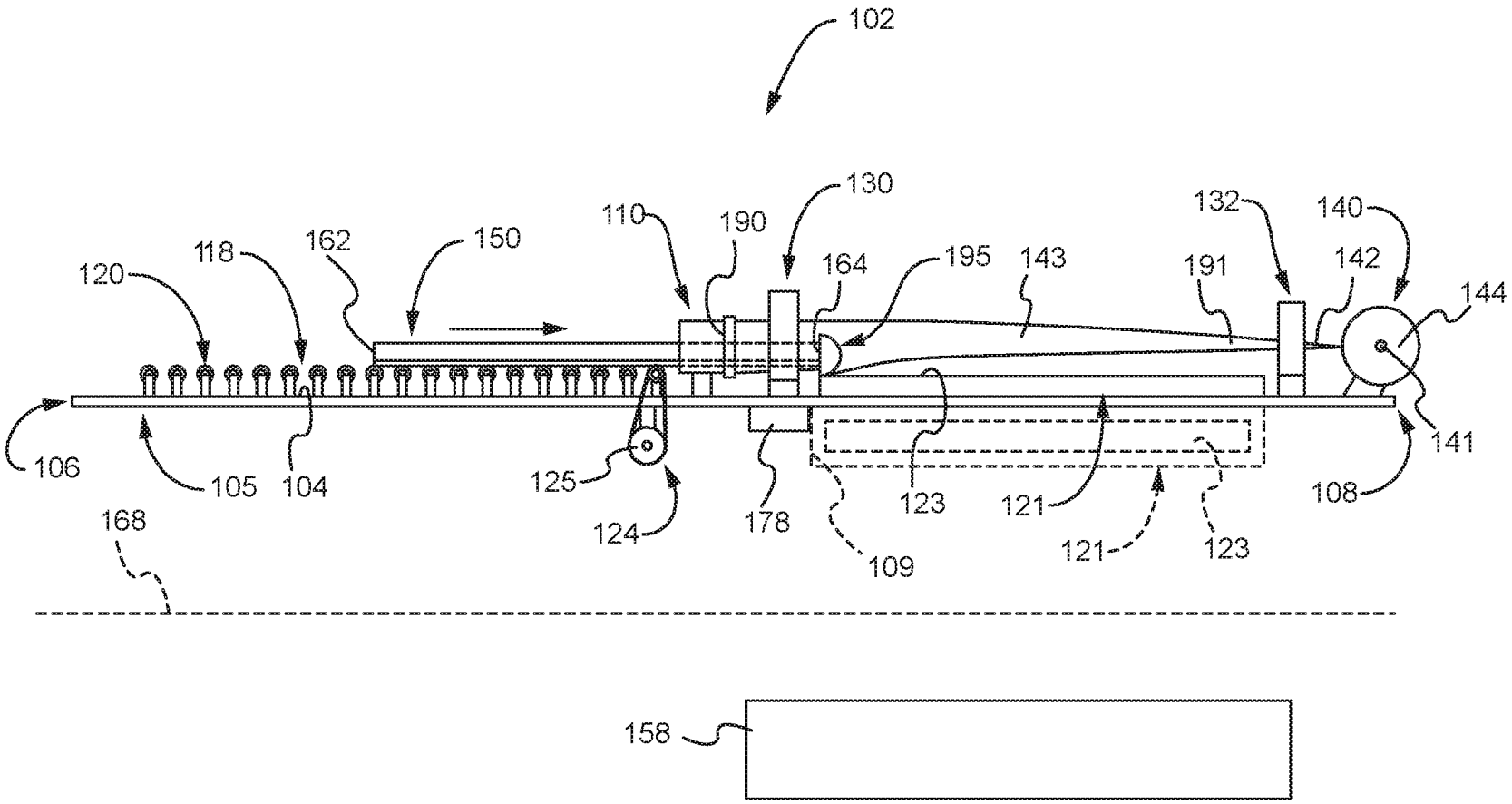
Figure 7:
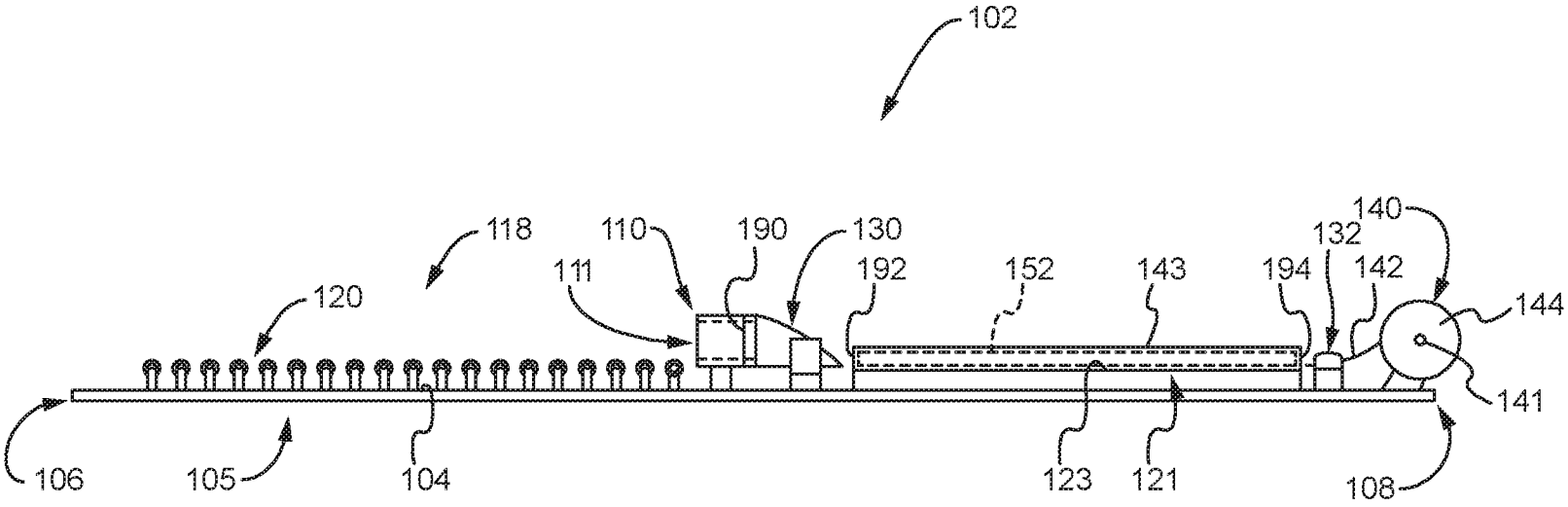

Referring generally to FIG. 1, and particularly to, e.g., FIGS. 6 and 7, the instant paragraph pertains to example 4 of the present disclosure. According to example 4, which includes the subject matter of example 3, above, at least one sleeve 143 comprises open end 190.

Open end 190 facilitates the insertion of component 150 into at least one sleeve 143.

Referring generally to FIG. 1, and particularly to, e.g., FIGS. 6 and 7, the instant paragraph pertains to example 5 of the present disclosure. According to example 5, which includes the subject matter of example 3, above, at least one sleeve 143 comprises two open ends 190.

Two open ends 190 enable at least one sleeve 143 to accommodate packaging of components 150 of various lengths.

Referring generally to FIGS. 1-4 and 6-9, the instant paragraph pertains to example 6 of the present disclosure. According to example 6, which includes the subject matter of any of examples 3-5, above, at least one sleeve 143 is made of a polymeric material.

Polymeric material allows at least one sleeve 143 to be flexible, sealable, and cuttable.

Referring generally to FIG. 1, and particularly to, e.g., FIGS. 3, 4, and 6-9, the instant paragraph pertains to example 7 of the present disclosure. According to example 7, which includes the subject matter of any of examples 2-6, above, packaging dispenser 144 comprises spool 141 configured to dispense roll 144 of packaging material 142.

Spool 141 enables efficient dispensing of packaging material 142. Roll 144 of packaging material facilitates a continuous and compact supply of packaging material.

Referring generally to FIG. 1, and particularly to, e.g., FIGS. 3, 4, and 6-8, the instant paragraph pertains to example 8 of the present disclosure. According to example 8, which includes the subject matter of any of examples 1-7, above, transporter 118 comprises first rollers 120.

First rollers 120 facilitate ease in advancing component 150 along transporter 118 and through feed tube 110.

Referring generally to FIG. 1, and particularly to, e.g., FIGS. 3, 4, and 6-8, the instant paragraph pertains to example 9 of the present disclosure. According to example 9, which includes the subject matter of example 8, above, transporter 118 further comprises at least one active roller 124.

At least one active roller 124 supplies a force that aids in advancing component 150 along transporter 118 and through feed tube 110. Force from at least one active roller 124 may be sufficient to advance component 150 into and through feed tube 110.

Referring generally to FIG. 1, and particularly to, e.g., FIGS. 3, 4, and 6-8, the instant paragraph pertains to example 10 of the present disclosure. According to example 10, which includes the subject matter of example 9, above, at least one active roller 124 is driven by motor 125.

Motor 125 enables precise control of advancement of component 150 along transporter 118 and through feed tube 110.

Referring generally to FIG. 1, and particularly to, e.g., FIGS. 3, 4, and 6-8, the instant paragraph pertains to example 11 of the present disclosure. According to example 11, which includes the subject matter of any of examples 8-10, above, first rollers 120 are passive rollers.

Passive rollers 120 reduce the force necessary to translationally move component 150 along transporter 118 and through feed tube 110.

Figure 9:
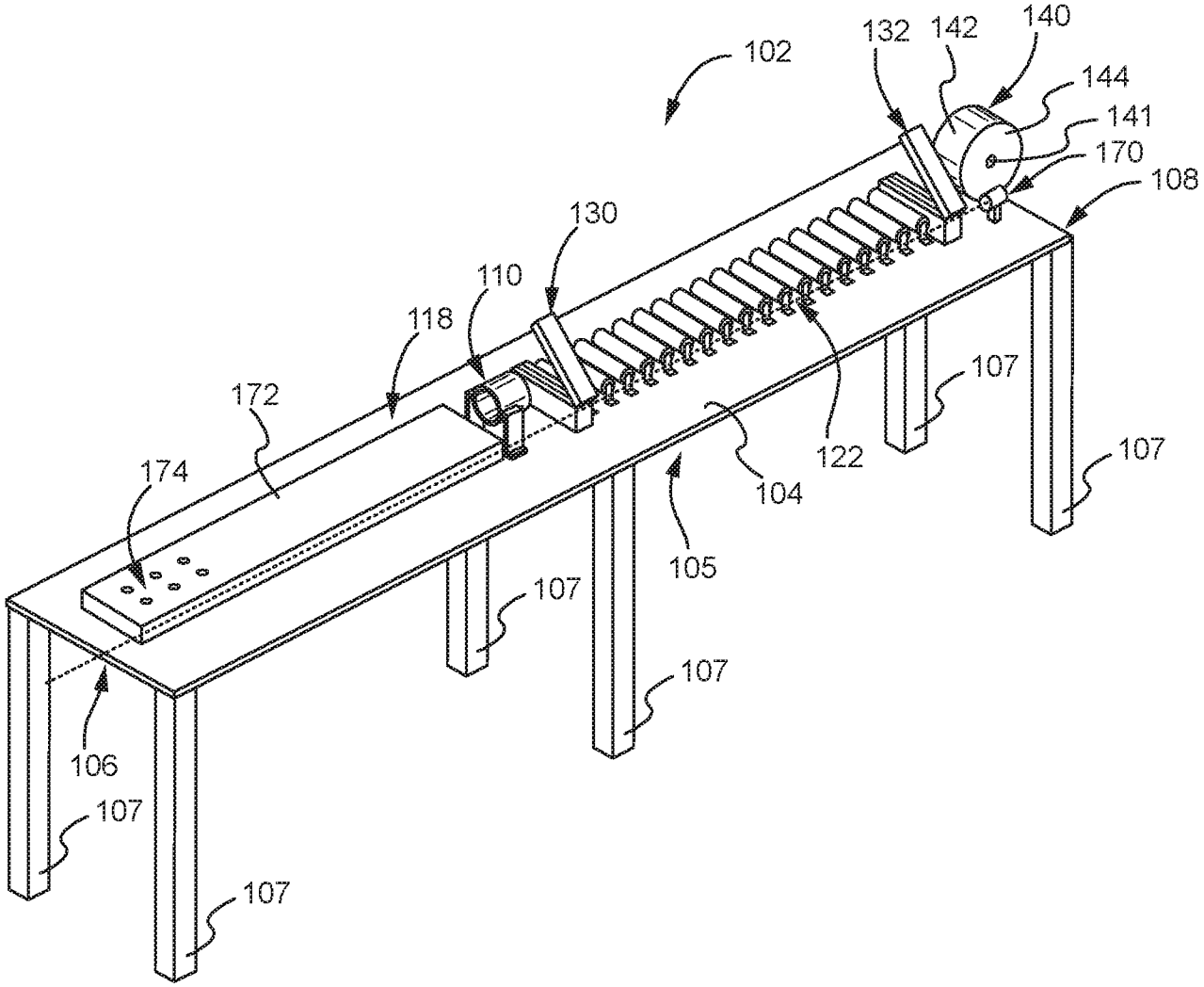

Referring generally to FIG. 1, and particularly to, e.g., FIG. 9, the instant paragraph pertains to example 12 of the present disclosure. According to example 12, which includes the subject matter of any of examples 1-7, above, transporter 118 comprises low-friction surface 172.

Low-friction surface 172 facilitates the lowering of the frictional force (e.g., static force) between component 150 and transporter 118. In this manner, the force necessary to overcome the frictional force and translationally move component 150 along transporter 118 and through feed tube 110 is correspondingly lowered. Low-friction surface 172 can be made of a low-friction material, such as Teflon®.

Referring generally to FIG. 1, and particularly to, e.g., FIG. 9, the instant paragraph pertains to example 13 of the present disclosure. According to example 13, which includes the subject matter of any of examples 1-7 and 12, above, transporter 118 comprises air bearing 174.

Air bearing 174 facilitates the lowering of the frictional force between component 150 and transporter 118. Air bearing 174 may include one or more apertures through which air is flowable. The force of the air acts to at least partially buoy or elevate component 150 above transporter 118.

Figure 8:
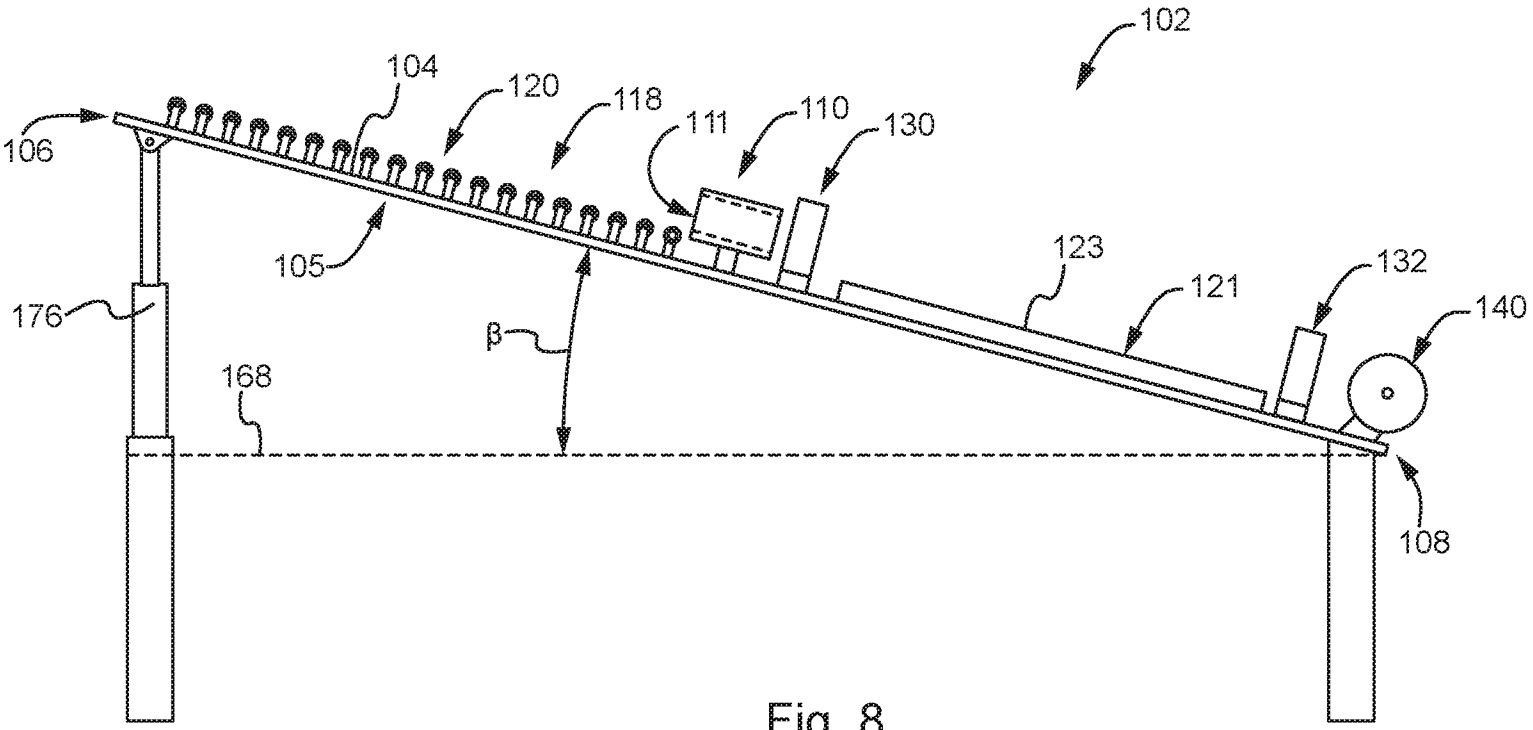

Referring generally to FIG. 1, and particularly to, e.g., FIG. 8, the instant paragraph pertains to example 14 of the present disclosure. According to example 14, which includes the subject matter of any of examples 1-13, above, base surface 104 has angle β with respect to virtual horizontal plane 168.

Angling base surface 104 facilitates a lower frictional force between component 150 and transporter 118. Base surface 104 at angle β enables gravity to assist in advancing component 150 through feed tube 110.

Referring generally to FIG. 1, and particularly to, e.g., FIG. 8, the instant paragraph pertains to example 15 of the present disclosure. According to example 15, which includes the subject matter of example 14, above, angle β is adjustable.

Adjustable angle β accommodates a lower frictional force between components 150 of different sizes and weights, and transporter 118.

Referring generally to FIG. 1, and particularly to, e.g., FIG. 8, the instant paragraph pertains to example 16 of the present disclosure. According to example 16, which includes the subject matter of example 14, above, angle β is zero degrees.

Angle β is zero degrees enables advancement of component 150 through feed tube 110 when a lowering of the frictional force between component 150 and transporter 118 is not desired.

Referring generally to FIG. 1, and particularly to, e.g., FIG. 8, the instant paragraph pertains to example 17 of the present disclosure. According to example 17, which includes the subject matter of any of examples 14-15, above, first end 106 of base surface 104 is elevated relative to second end 108 of base surface 104.

Elevation of base surface 104 relative to second end 108 facilitates the lowering of the frictional force between component 150 and transporter 118.

Referring generally to FIG. 1, and particularly to, e.g., FIGS. 3, 4, and 6-9, the instant paragraph pertains to example 18 of the present disclosure. According to example 18, which includes the subject matter of any of examples 1-17, above, packaging apparatus 102 further comprises support 121 between first sealer 130 and second sealer 132.

Support 121 provides a support for component 150 after component 150 is advanced through feed tube 110.

Referring generally to FIG. 1, and particularly to, e.g., FIG. 6, the instant paragraph pertains to example 19 of the present disclosure. According to example 19, which includes the subject matter of example 18, above, support 121 is tiltable relative to virtual horizontal plane 168 about an axis parallel to feed tube 110.

Tiltability of support 121 facilitates moving component 150 off of support 121 after packaging component 150. Furthermore, tiltability of support 121 may utilize gravity to aid in moving component 150 off of support 121 after packaging component 150. Tilting support 121 may move off of support 121 and into a second storage.

Referring generally to FIG. 1, and particularly to, e.g., FIGS. 2-4 and 6-8, the instant paragraph pertains to example 20 of the present disclosure. According to example 20, which includes the subject matter of any of examples 18-19, above, support 121 includes substantially planar surface 123.

Substantially planar surface 123 promotes uniform support of component 150 on support 121.

Referring generally to FIG. 1, and particularly to, e.g., FIG. 9, the instant paragraph pertains to example 21 of the present disclosure. According to example 21, which includes the subject matter of any of examples 18-19, above, support 121 comprises second rollers 122.

Second rollers 122 facilitate ease in advancing component 150 along support 121 after advancing through feed tube 110. Second rollers 122 reduce the force necessary to translationally move component 150 along support 121.

Referring generally to FIG. 1, and particularly to, e.g., FIG. 6, the instant paragraph pertains to example 22 of the present disclosure. According to example 22, which includes the subject matter of any of examples 1-21, above, at least portion 109 of base surface 104 is tiltable about an axis parallel to feed tube 110.

Tiltability of at least one portion 109 of base surface 104 enables component 150 that has been packaged to move (e.g., slide or drop) from base surface 104, such as via gravity, into second storage 158 or other location for storing components 150 that have been packaged.

Figure 4:
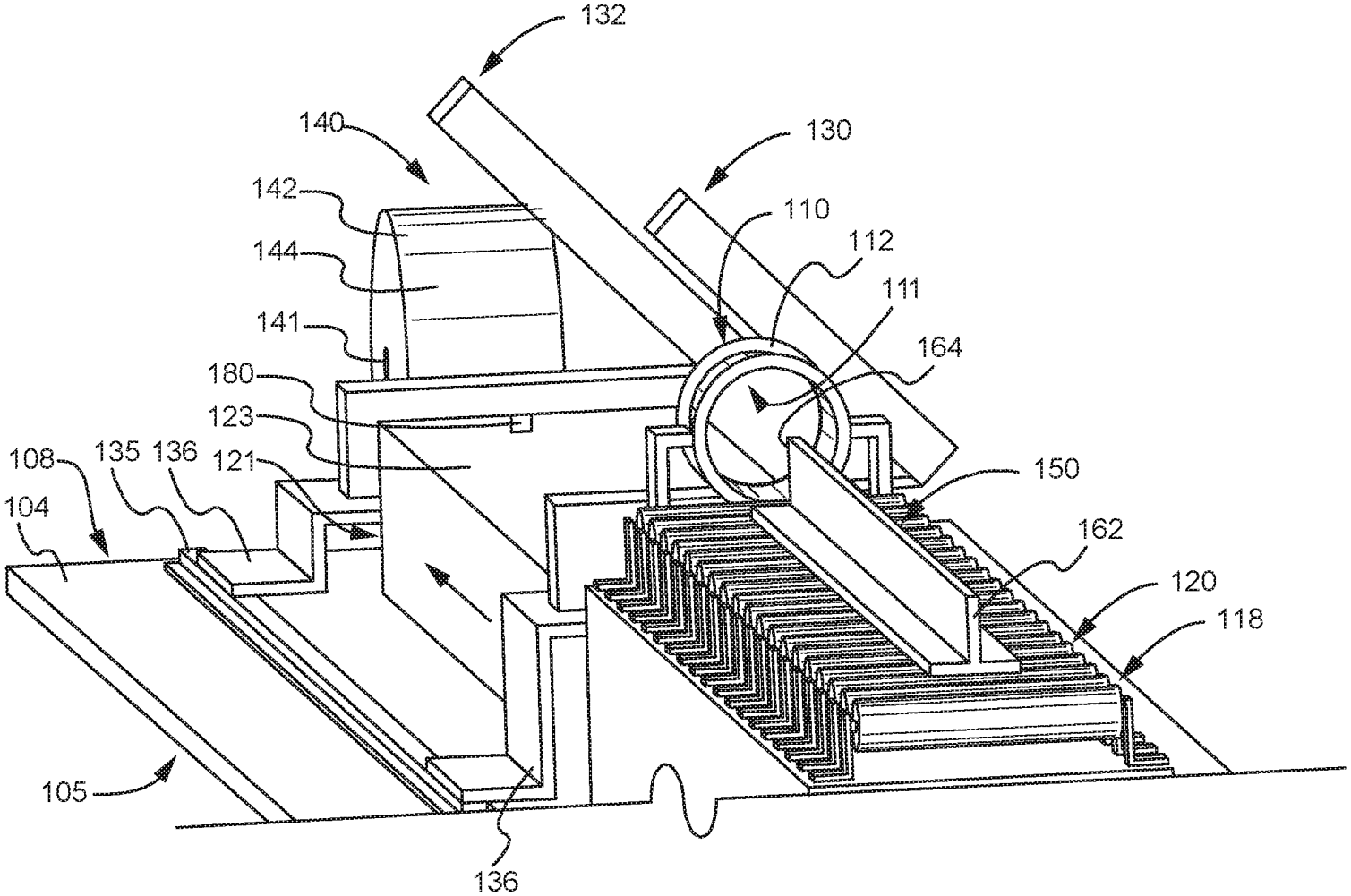

Referring generally to FIG. 1, and particularly to, e.g., FIG. 4, the instant paragraph pertains to example 23 of the present disclosure. According to example 23, which includes the subject matter of any of examples 1-22, above, packaging apparatus 102 further comprises position sensor 180 operatively coupled to at least one of first sealer 130 and second sealer 132.

Position sensor 180 senses the presence of component 150. Operatively coupling position sensor 180 to first sealer 130 and second sealer 132 enables sealing operations to proceed with component 150 in a proper position for sealing responsive to position sensor 180 sensing the presence of component 150.

Referring generally to FIG. 1, and particularly to, e.g., FIG. 4, the instant paragraph pertains to example 24 of the present disclosure. According to example 24, which includes the subject matter of any of examples 1-22, above, packaging apparatus 102 further comprises position sensor 180 operatively coupled to transporter 118.

Operatively coupling position sensor 180 to transporter 118 enables transporter to transport or advance component 150 on transporter 118 through feed tube 110 responsive to position sensor 180 sensing a presence of component 150. The sensed presence can include the presence of one component 150 between first sealer 130 and second sealer 132, which triggers transporter 118 to advance another component 150 on transporter 118. Additionally, or alternatively, position sensor 180 may sense presence of component 150 on transporter 118, which triggers transporter 118 to advance that component 150 on transporter 118.

Referring generally to FIG. 1, and particularly to, e.g., FIG. 4, the instant paragraph pertains to example 25 of the present disclosure. According to example 25, which includes the subject matter of example 24, above, position sensor 180 also is operatively coupled to at least one of first sealer 130 and second sealer 132.

Operatively coupling position sensor 180 to first sealer 130 and second sealer 132 also enables sealing operations to proceed with component 150 in a proper position for sealing responsive to position sensor 180 sensing the presence of component 150, which can be the presence of component 150 between first sealer 130 and second sealer 132.

Referring generally to FIG. 1, and particularly to, e.g., FIGS. 3, 4, and 6-9, the instant paragraph pertains to example 26 of the present disclosure. According to example 26, which includes the subject matter of any of examples 1-25, above, first sealer 130 and second sealer 132 are separated by distance D.

Separation of first sealer 130 and second sealer 132 by distance D enables component 150 to be positioned between first sealer 130 and second sealer 132. Distance D may be equal to or greater than the length of component 150.

Referring generally to FIG. 1, and particularly to, e.g., FIGS. 3, 4, and 6-9, the instant paragraph pertains to example 27 of the present disclosure. According to example 27, which includes the subject matter of example 26, above, distance D is adjustable.

Adjustable distance D facilitates sealing components 150 of various lengths.

Referring generally to FIG. 1, and particularly to, e.g., FIGS. 3, 4, and 6-9, the instant paragraph pertains to example 28 of the present disclosure. According to example 28, which includes the subject matter of example 27, above, base surface 104 further comprises track 135 and distance D is adjustable by moving at least one of first sealer 130 and second sealer 132 along track 135.

Track 135 facilitates adjustability of distance D. Also, track 135 may maintain at least one of first sealer 130 and second sealer 132 in a constant lateral position as at least one of first sealer 130 and second sealer 132 move along track 135.

Referring generally to FIG. 1, and particularly to, e.g., FIGS. 3, 4, and 6-9, the instant paragraph pertains to example 29 of the present disclosure. According to example 29, which includes the subject matter of any of examples 26-28, above, at least one of first sealer 130 and second sealer 132 comprises repositioner 136 configured to adjust distance D between first sealer 130 and second sealer 132.

Repositioner 136 facilitates adjustability of distance D while maintaining height of at least one of first sealer 130 and second sealer 132 relative to feed tube 110.

Referring generally to FIG. 1, and particularly to, e.g., FIG. 4, the instant paragraph pertains to example 30 of the present disclosure. According to example 30, which includes the subject matter of any of examples 1-29, above, feed tube 110 comprises means 112 for attaching packaging material 142 to feed tube 110.

Means 112 for attaching packaging material 142 to feed tube 110 promotes effective coupling of packaging material 142 to feed tube 110 in preparation for insertion of component 150 into packaging material 142. In FIG. 4, means 112 may include a clamp that clamps packaging material 142 against feed tube 110. Alternatively, instead of or in addition to the clamp, means 112 may include an adhesive, serrations, teeth, a cable tie, an elastic band, or the like.

Figure 3:
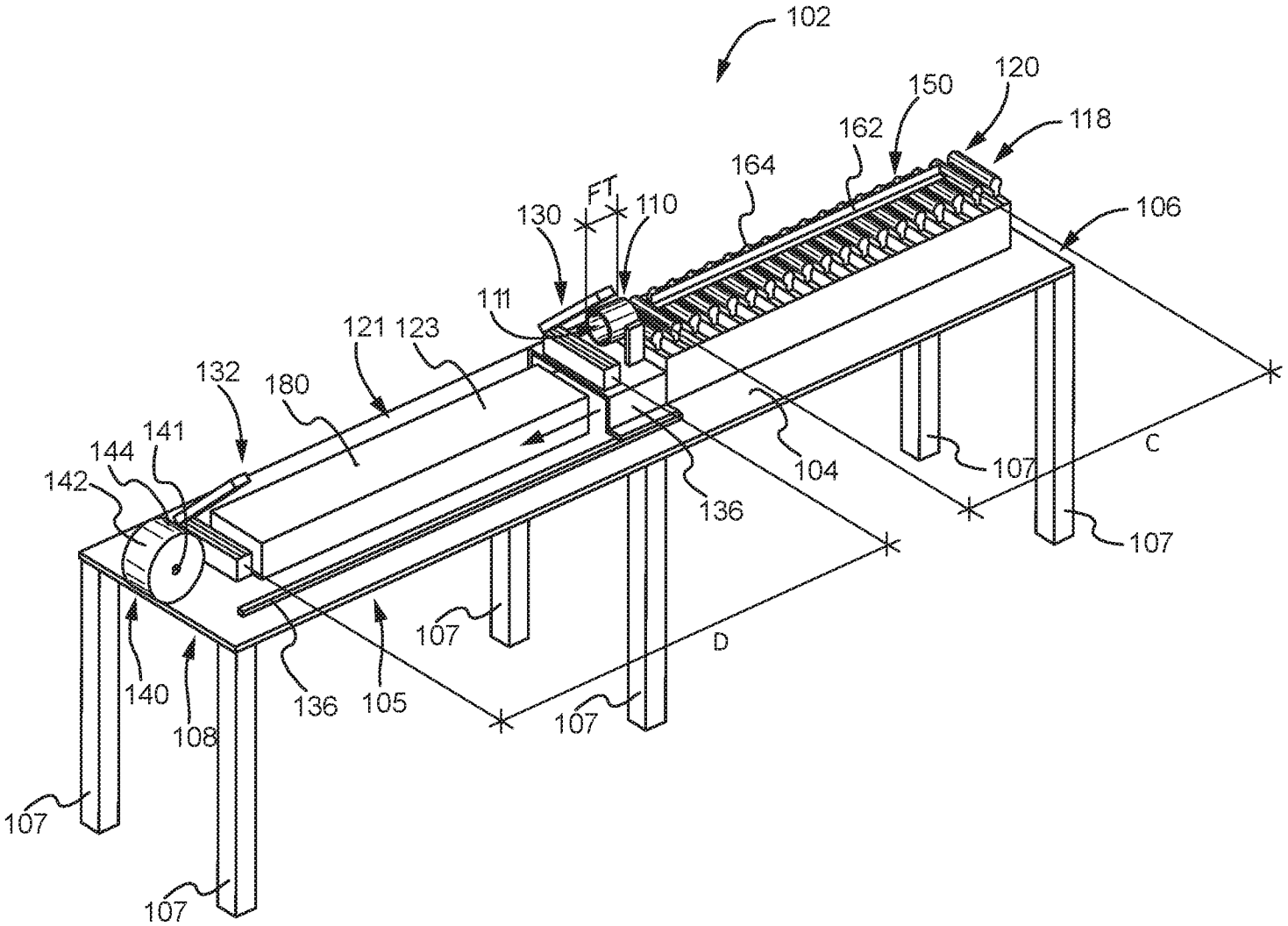

Referring generally to FIGS. 1, 4, and 6-8, and particularly to, e.g., FIG. 3, the instant paragraph pertains to example 31 of the present disclosure. According to example 31, which includes the subject matter of any of examples 1-30, above, feed tube 110 has length FT, component 150 to be packaged has length C, and length FT is shorter than length C.

Length FT being shorter than length C allows component 150 to pass through feed tube 110 and into packaging material 142, such as sleeve 143.

Referring generally to FIG. 1, and particularly to, e.g., FIGS. 3, 4, 7, and 8, the instant paragraph pertains to example 32 of the present disclosure. According to example 32, which includes the subject matter of any of examples 1-31, above, feed tube 110 defines aperture 111 sized to allow component 150 to pass therethrough.

Aperture 111 being sized to allow component 150 to pass therethrough enables component 150 to be received within packaging material 142 coupled to feed tube 110. In one example, aperture 111 has a major dimension (e.g., diameter) larger than a major dimension of the cross-section (e.g., height) of component 150.

Figure 5:
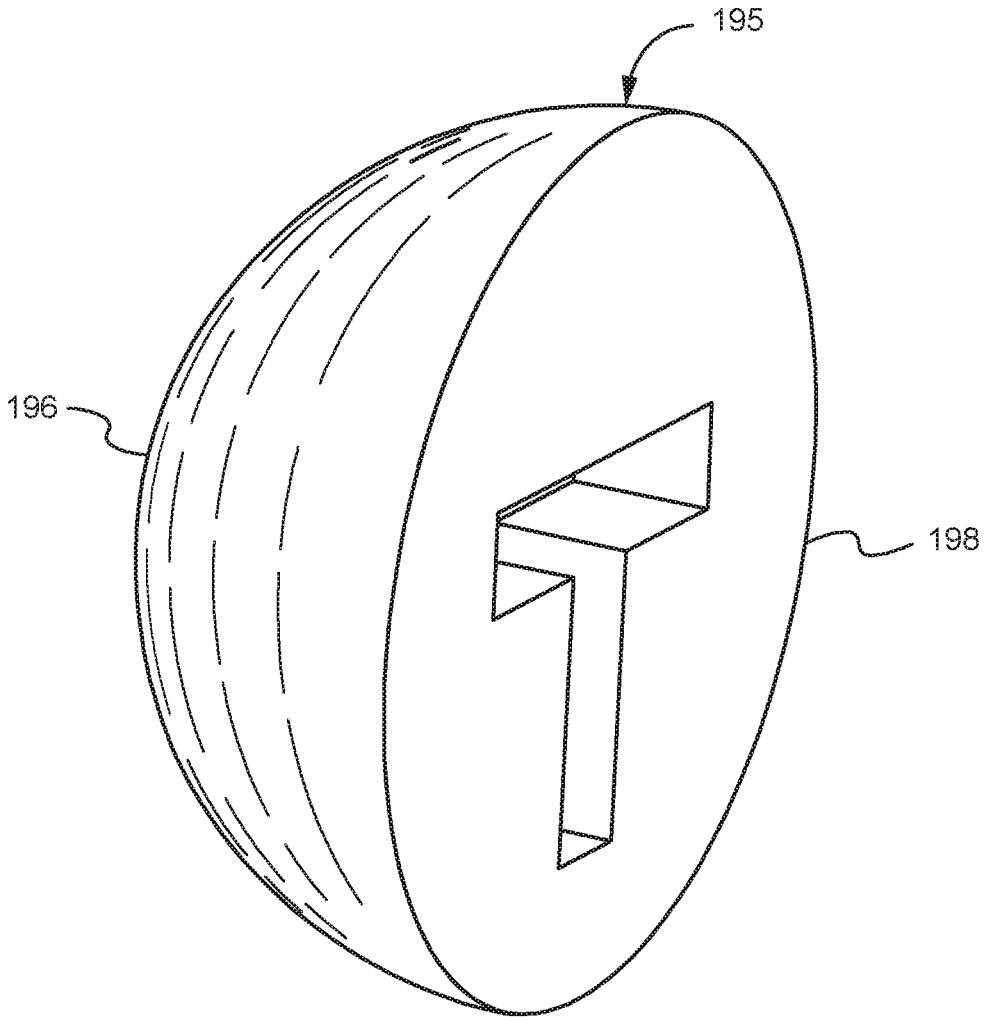

Referring generally to FIG. 1, and particularly to, e.g., FIGS. 5-6, the instant paragraph pertains to example 33 of the present disclosure. According to example 33, which includes the subject matter of any of examples 1-32, above, packaging apparatus 102 further comprises end cap 195 configured to cover leading end 164 of component 150 to be packaged.

End cap 195 facilitates the advancement of leading end 164 of component 150 through packaging material 142. Leading end 164 of component 150 may be configured such that leading end 164 may drag or snag on packaging material 142 as it is advanced through packing material 142. End cap 195 provides leading end 164 configured to reduce drag and snagging on packaging material 142.

Referring generally to FIG. 1, and particularly to, e.g., FIGS. 5-6, the instant paragraph pertains to example 34 of the present disclosure. According to example 34, which includes the subject matter of example 33, above, end cap 195 comprises curved convex leading surface 196.

Curved convex leading surface 196 provides a leading surface that reduces drag and snagging on packaging material 142 as component 150 advances through packaging material 142.

Referring generally to FIG. 1, and particularly to, e.g., FIGS. 5-6, the instant paragraph pertains to example 35 of the present disclosure. According to example 35, which includes the subject matter of example 34, above, curved convex leading surface 196 is dome-shaped.

The dome shape of curved convex leading surface 196 provides a leading surface that reduces drag and snagging on packaging material 142 as component 150 advances through packaging material 142.

Referring generally to FIGS. 1 and 6, and particularly to, e.g., FIG. 5, the instant paragraph pertains to example 36 of the present disclosure. According to example 36, which includes the subject matter of any of examples 33-35, above, end cap 195 comprises recess 198 configured to receive leading end 164 of component 150, component 150 has a first cross-sectional shape, recess 198 has a second cross-sectional shape, and the second cross-sectional shape of recess 198 and the first cross-sectional shape of leading end 164 of component 150 are complementary shapes.

The first cross-sectional shape of component 150 and second cross-sectional shape of recess 198 are complementary to provide a removably secure fit between component 150 and end cap 195. The removably secure fit enables end cap 195 to stay on leading end 164 of component 150 as component 150 is advanced through packaging material 142. After component 150 is entirely within packaging material 142, and before sealing of component 150 within packaging material 142, end cap 195 is removed from leading end 164 of component 150.

Referring generally to FIG. 1, and particularly to, e.g., FIG. 9, the instant paragraph pertains to example 37 of the present disclosure. According to example 37, which includes the subject matter of any of examples 1-36, above, packaging apparatus 102 further comprises means 170 for aligning component 150 with feed tube 110.

Means 170 for aligning component 150 with feed tube 110 facilitates proper advancement of component 150 through feed tube 110. Misalignment between component 150 and feed tube 110 may result in component 150 binding with feed tube 100. Means 170 for aligning component 150 helps to avoid misalignment between component 150 and feed tube 110. In the example of FIG. 3, means 170 for aligning component 150 includes an optical indication of alignment relative to feed tube 110. According to an example, the optical indication is a laser sensor that senses the alignment of component 150 with feed tube 110. In one example, the laser sensor provides feedback regarding the alignment of component 150 with feed tube 110. Alternatively, instead of or in addition to an optical indication, means 170 may include a physical indication, such as a boundary, wall, tabs, rails, or the like, used as a guide for ensuring alignment between component 150 and feed tube 110.

Now referring to, e.g., FIGS. 1-4 and 6-9, the instant paragraph pertains to example 38 of the present disclosure. Example 38 relates to packaging system 100. According to example 38, packaging system 100 comprises base surface 104 in turn comprising first end 106 and second end 108. Packaging system 100 further comprises feed tube 110 between first end 106 and second end 108 of base surface 104, and transporter 118 between first end 106 of base surface 104 and feed tube 110. Additionally, packaging system 100 comprises first sealer 130 between feed tube 110 and second end 108 of base surface 104, and second sealer 132 between first sealer 130 and second end 108 of base surface 104. Packaging system 100 also comprises position sensor 180 between first sealer 130 and second sealer 132, and robotic arm 156 operatively coupled with position sensor 180.

As described above, position sensor 180 senses the presence of component 150. Sensing the presence of component 150 by the position sensor 180 facilitates one or more operations of packaging system 100. Based on position sensor 180 sensing the presence of component 150, packaging system 100 may execute a sealing operation with the first sealer 130 and second sealer 132, transporting operation with transporter 118, and/or other operations. Robotic arm 156 facilitates ease in manipulating component 150. Operatively coupling robotic arm 156 with position sensor 180 enables robotic arm 156 to manipulate component 150 responsive to position sensor 180 sensing the presence of component 150.

Referring generally to FIG. 1, and particularly to, e.g., FIG. 4, the instant paragraph pertains to example 39 of the present disclosure. According to example 39, which includes the subject matter of example 38, above, first sealer 130 and second sealer 132 are operatively coupled with position sensor 180.

As mentioned above, operatively coupling position sensor 180 to first sealer 130 and second sealer 132 enables sealing operations to proceed responsive to position sensor 180 sensing the presence of component 150 between first sealer 130 and second sealer 132.

Figure 2:
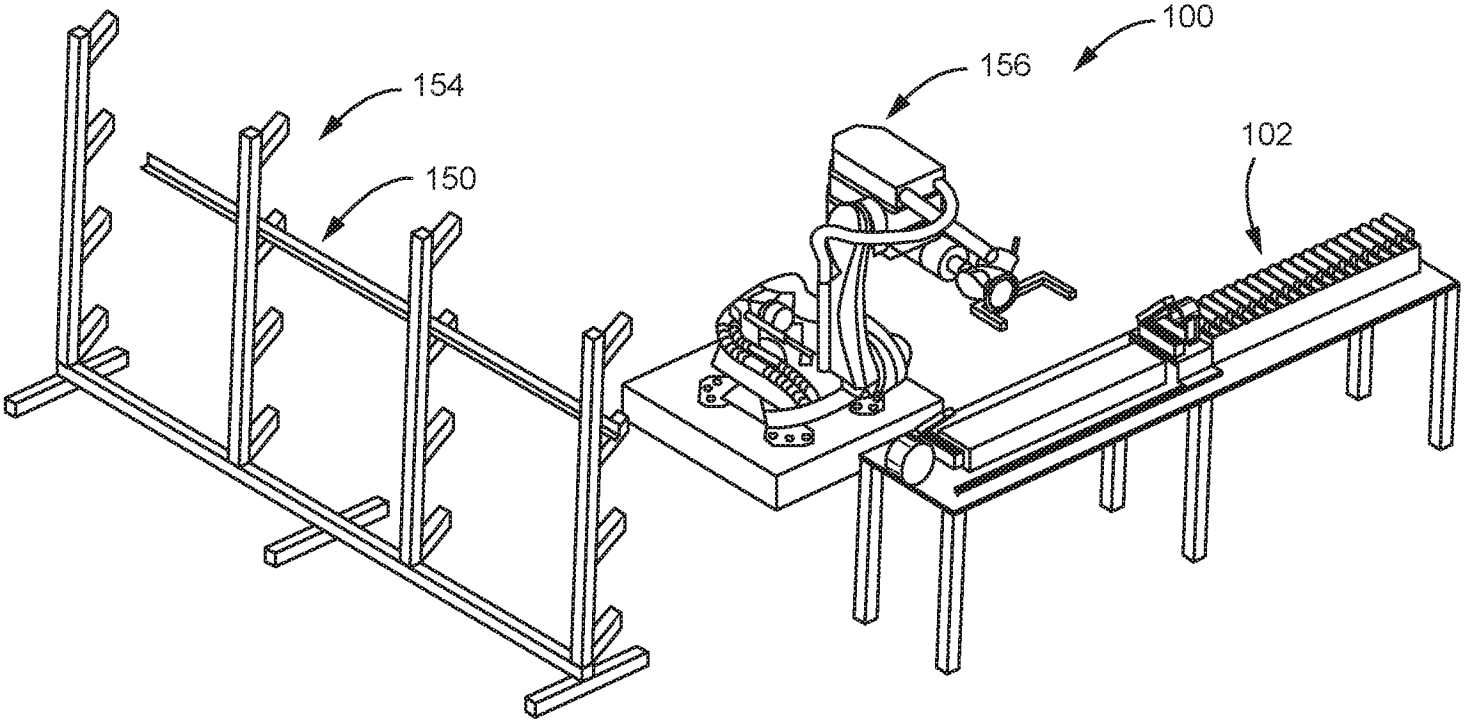

Referring generally to FIG. 1, and particularly to, e.g., FIG. 2, the instant paragraph pertains to example 40 of the present disclosure. According to example 40, which includes the subject matter of any of examples 38-39, above, packaging system 100 further comprises first storage 154 configured to be accessible by robotic arm 156. First storage 154 is configured to store at least one component 150 before a packaging operation.

Robotic arm 156 automates manipulation of component 150 relative to packaging system 100. First storage 154 enables convenient and accessible storage of components 150 to be packaged (e.g., sealed within packaging material 142) by packaging apparatus 102.

Referring generally to FIG. 1, and particularly to, e.g., FIGS. 2 and 3, 4, and 6-9, the instant paragraph pertains to example 41 of the present disclosure. According to example 41, which includes the subject matter of example 40, above, robotic arm 156 is programmed to transfer component 150 from first storage 154 to transporter 118.

Robotic arm 156 automates and facilitates ease in retrieval and transfer of component 150 from first storage 154 to transporter 118.

Referring generally to FIG. 1, and particularly to, e.g., FIGS. 2 and 6, the instant paragraph pertains to example 42 of the present disclosure. According to example 42, which includes the subject matter of any of examples 38-41, above, packaging system 100 further comprises second storage 158 configured to be accessible by robotic arm 156. Second storage 158 is configured to store at least one component 150 after a packaging operation.

Robotic arm 156 automates and facilitates ease in retrieval and transfer of component 150 from packaging apparatus 102 to second storage 158.

Referring generally to FIG. 1, and particularly to, e.g., FIGS. 2, and 4, the instant paragraph pertains to example 43 of the present disclosure. According to example 43, which includes the subject matter of any of examples 38-42, above, robotic arm 156 is programmed to perform a manipulation of component 150 after receiving a signal from position sensor 180, and position sensor 180 generates the signal responsive to being activated by component 150 being positioned between first sealer 130 and second sealer 132.

Programming of robotic arm 156 to perform the manipulation of component 150 after receiving the signal from position sensor 180 facilitates the automation of robotic arm 156 relative to the manipulation of component 150.

Referring generally to FIG. 1, and particularly to, e.g., FIGS. 2, and 4, the instant paragraph pertains to example 44 of the present disclosure. According to example 44, which includes the subject matter of example 43, above, robotic arm 156 is programmed to perform the manipulation of component 150 a predetermined time after receiving the signal from position sensor 180.

Performing the manipulation of component 150 a predetermined time after receiving the signal from position sensor 180 enables component 150 to be completely packaged (e.g., sealed) before robotic arm 156 manipulates component 150.

Referring generally to FIGS. 1-4 and 6-9, and particularly to FIG. 10, the instant paragraph pertains to example 45 of the present disclosure. Example 45 relates to a packaging method 200. According to example 45, the packaging method 200 comprises coupling open end 190 of sleeve 143 to feed tube 110 (block 220); advancing component 150 through feed tube 110 until component 150 is entirely within sleeve 143 (block 230); and sealing sleeve 143 from open end 190 (block 240).

Method 200 facilitates ease and efficiency for packaging component 150. As mentioned above, coupling open end 190 of sleeve 143, which is flexible in some examples, to rigid structure of feed tube 110 effectively makes open end 190 rigid for easily receiving component 150. With open end 190 of sleeve 143 coupled to feed tube 110, advancing component 150 through feed tube 110 ensures component 150 enters and passes through feed tube 110.

Referring generally to FIGS. 1-4 and 6-10, the instant paragraph pertains to example 46 of the present disclosure. According to example 46, which includes the subject matter of example 45, above, sealing sleeve 143 from open end 190 forms closed end 192 of sleeve 143.

Forming closed end 192 in sleeve 143 enables sleeve 143 to contain component 150 within sleeve 143.

Referring generally to FIGS. 1-4 and 6-9, and particularly to FIG. 10, the instant paragraph pertains to example 47 of the present disclosure. According to example 47, which includes the subject matter of example 46, above, method 200 further comprises forming second closed end 194 of sleeve 143 (block 250).

Forming second closed end 194 of sleeve 143 enables sleeve 143 to contain component 150 within sleeve 143.

Referring generally to FIGS. 1-4 and 6-10, the instant paragraph pertains to example 48 of the present disclosure. According to example 48, which includes the subject matter of example 47, above, second closed end 194 of sleeve 143 is formed by sealing sleeve 143 from second end 191.

Sleeve 143 can be a continuous sleeve. Forming closed end 192 and second closed end 194 in continuous sleeve facilitates flexibility for sealing components 150 of various lengths.

Continuing to refer generally to FIGS. 1-4 and 6-10, the instant paragraph pertains to example 49 of the present disclosure. According to example 49, which includes the subject matter of example 48, above, method 200 further comprises adjusting distance D separating closed end 192 and second closed end 194 prior to sealing sleeve 143 from open end 190 and from second end 191.

Adjustable distance D facilitates sealing components 150 of various lengths.

Referring generally to FIGS. 1-4 and 6-9, and particularly to FIG. 10, the instant paragraph pertains to example 50 of the present disclosure. According to example 50, which includes the subject matter of any of examples 48-49, above, method 200 further comprises cutting sleeve 143 at second end 191 (block 252).

Cutting sleeve 143 at second end 191 enables length of sleeve 143 to be defined.

Referring generally to FIGS. 1-4 and 6-10, the instant paragraph pertains to example 51 of the present disclosure. According to example 51, which includes the subject matter of example 50, above, cutting sleeve 143 at second end 191 and sealing sleeve 143 from second end 191 are performed simultaneously.

Simultaneously performing cutting sleeve 143 at second end 191 and sealing sleeve 143 from second end 191 reduces operational steps, reduces time, reduces errors, and increases efficiency.

Referring generally to FIGS. 1-4 and 6-10, the instant paragraph pertains to example 52 of the present disclosure. According to example 52, which includes the subject matter of example 51, above, cutting sleeve 143 at second end 191 and sealing sleeve 143 from second end 191 are performed by a single device.

Using a single device to perform cutting sleeve 143 at second end 191 and sealing sleeve 143 from second end 191 reduces number of devices for packaging component 150. Simultaneous performance of cutting sleeve 143 at second end 191 and sealing sleeve 143 from second end 191 can be facilitated by a single heat sealer. The heat sealer provides enough heat and pressure to both seal sleeve 143 and cut sleeve 143 at the same time. The heat sealer may include a first heated portion and a second heated portion that move relative to each other to clamp sleeve 143 therebetween and to seal and cut sleeve 143. Other devices may be used to simultaneously seal sleeve 143 from second end 191 and cut sleeve 143 at second end 191.

Referring generally to FIGS. 1-4 and 6-10, the instant paragraph pertains to example 53 of the present disclosure. According to example 53, which includes the subject matter of any of examples 45-52, above, method 200 further comprises advancing sleeve 143 from packaging dispenser 140 toward feed tube 110.

Advancing sleeve 143 from packaging dispenser 140 enables fast and efficient coupling of sleeve 143 to feed tube 110.

Referring generally to FIGS. 1-4 and 6-10, the instant paragraph pertains to example 54 of the present disclosure. According to example 54, which includes the subject matter of example 53, above, coupling open end 190 of sleeve 143 to feed tube 110 comprises clamping open end 190 to feed tube 110.

Clamping open end 190 of sleeve 143 to feed tube 100 provides removably secure coupling of the open end 190 of sleeve 143 to feed tube 100.

Referring generally to FIGS. 1-4 and 6-9, and particularly to FIG. 10, the instant paragraph pertains to example 55 of the present disclosure. According to example 55, which includes the subject matter of any of examples 45-54, above, method 200 further comprises cutting sleeve 143 at open end 190 of sleeve 143 (block 242).

Cutting sleeve 143 at open end 190 enables length of sleeve 143 to be defined.

Referring generally to FIGS. 1-4 and 6-10, the instant paragraph pertains to example 56 of the present disclosure. According to example 56, which includes the subject matter of example 55, above, cutting sleeve 143 at open end 190 and sealing sleeve 143 from open end 190 are performed simultaneously.

Simultaneously performing cutting sleeve 143 at open end 190 and sealing sleeve 143 from open end 190 reduces operational steps, reduces time, reduces errors, and increases efficiency.

Referring generally to FIGS. 1-4 and 6-10, the instant paragraph pertains to example 57 of the present disclosure. According to example 57, which includes the subject matter of example 56, above, cutting sleeve 143 at open end 190 and sealing sleeve 143 from open end 190 are performed by a single device.

Using a single device to perform cutting sleeve 143 at open end 190 and sealing sleeve 143 from open end 190 reduces number of devices for packaging component 150. Simultaneous performance of cutting sleeve 143 at open end 190 and sealing sleeve 143 from open end 190 can be facilitated by a single heat sealer. The heat sealer provides enough heat and pressure to both seal sleeve 143 and cut sleeve 143 at the same time. The heat sealer may include a first heated portion and a second heated portion that move relative to each other to clamp sleeve 143 therebetween and to seal and cut sleeve 143. Other devices may be used to simultaneously seal sleeve 143 from open end 190 and cut sleeve 143 at open end 190.

Referring generally to FIGS. 1-4 and 6-9, and particularly to FIG. 10, the instant paragraph pertains to example 58 of the present disclosure. According to example 58, which includes the subject matter of any of examples 45-57, above, method 200 further comprises positioning component 150 on transporter 118 to advance component 150 through feed tube 110 (block 210).

Positioning component 150 on transporter 118 allows transporter 118 to facilitate advancement of component 150 through feed tube 110.

Referring generally to FIGS. 1-4 and 6-10, the instant paragraph pertains to example 59 of the present disclosure. According to example 59, which includes the subject matter of example 58, above, method 200 further comprises advancing component 150 along transporter 118.

Using transporter 118 to advance component 150 enables ease in advancing component 150 through feed tube 110.

Referring generally to FIGS. 1-4 and 6-10, the instant paragraph pertains to example 60 of the present disclosure. According to example 60, which includes the subject matter of example 59, above, advancing component 150 along transporter 118 comprises advancing component 150 using a gravitational force.

Advancing component 150 using a gravitational force lowers the frictional force between component 150 and transporter 118, and enables gravity to assist in advancing component 150 along transporter 118 and through feed tube 110.

Referring generally to FIGS. 1-4 and 6-10, the instant paragraph pertains to example 61 of the present disclosure. According to example 61, which includes the subject matter of example 59, above, advancing component 150 along transporter 118 comprises actuating at least one active roller 124.

Actuating at least one active roller 124 to advance component 150 along transporter 118 provides at least some of the force necessary for overcoming static frictional force and advancing component 150 along transporter 118 and through feed tube 110.

Referring generally to FIGS. 1, 2, and 10, the instant paragraph pertains to example 62 of the present disclosure. According to example 62, which includes the subject matter of any of examples 58-61, above, positioning component 150 on transporter 118 comprises manipulating component 150 with robotic arm 156.

Manipulation of component 150 with robotic arm 156 automates the manipulation of component 150 relative to packaging system 100.

Referring generally to FIGS. 1 and 2, and particularly to FIG. 10, the instant paragraph pertains to example 63 of the present disclosure. According to example 63, which includes the subject matter of example 62, above, method 200 further comprises positioning component 150 on transporter 118 (block 210) after retrieving 202 component 150 from first storage 154 with robotic arm 156 (block 202).

Robotic arm 156 automates retrieval and transfer of component 150 from first storage 154 to transporter 118 of packaging apparatus 102.

Referring generally to FIGS. 1-4 and 6-9, and particularly to FIG. 10, the instant paragraph pertains to example 64 of the present disclosure. According to example 64, which includes the subject matter of any of examples 45-63, above, method 200 further comprises sealing component 150 inside sleeve 143 by forming closed end 192 and second closed end 194 (block 250), and using robotic arm 156 to transfer component 150 sealed inside sleeve 143 to second storage 158 (block 258).

Transferring component 150 sealed inside sleeve 143 with robotic arm 156 automates retrieval and transfer of components 150 packaged by packaging apparatus 102 from packaging apparatus 102 to second storage 158.

Referring generally to FIGS. 1, 2, and 10, the instant paragraph pertains to example 65 of the present disclosure. According to example 65, which includes the subject matter of example 64, above, robotic arm 156 transfers component 150 sealed inside sleeve 143 to second storage 158 responsive to a signal associated with a location of component 150 relative to feed tube 110.

Operably coupling robotic arm 156 with position sensor 180 facilitates the automation of robotic arm 156 relative to manipulation of component 150.

Referring generally to FIGS. 1-4 and 6-9, and particularly to FIG. 10, the instant paragraph pertains to example 66 of the present disclosure. According to example 66, which includes the subject matter of any of examples 45-63, above, method 200 further comprises sealing component 150 inside sleeve 143 by forming closed end 192 and second closed end 194 (block 250) and tilting a surface, supporting component 150, to transfer component 150 sealed inside sleeve 143 into second storage 158.

Tilting surface supporting component 150 enables component 150 sealed inside sleeve 143 to move (e.g., slide or drop) off of support 121, such as via gravity, into second storage 158 or other location for storing sealed components 150. Utilizing gravity to transfer component 150 sealed inside sleeve 143 into second storage 158 reduces operational steps and standalone transfer devices.

Referring generally to FIGS. 1, 3, 4, and 6-10, the instant paragraph pertains to example 67 of the present disclosure. According to example 67, which includes the subject matter of any of examples 45-66, above, sealing sleeve 143 from open end 190 is responsive to a signal associated with a location of component 150 relative to feed tube 110.

Sealing sleeve 143 from open end 190 responsive to a signal associated with a location of component 150 relative to feed tube 110 ensures component 150 is in a proper position for sealing before sealing operation is performed.

Referring generally to FIGS. 1, 3, 4, and 6-10, the instant paragraph pertains to example 68 of the present disclosure. According to example 68, which includes the subject matter of example 67, above, method 200 further comprises sealing sleeve 143 from second end 191 responsive to the signal associated with the location of component 150 relative to feed tube 110.

Sealing sleeve 143 from second end 191 responsive to a signal associated with a location of component 150 relative to feed tube 110 ensures component 150 is in a proper position for sealing before sealing operation is performed.

Referring generally to FIGS. 1, 3, 4, and 6-10, the instant paragraph pertains to example 69 of the present disclosure. According to example 69, which includes the subject matter of any of examples 45-68, above, method 200 further comprises aligning component 150 with feed tube 110 responsive to a visual indicator.

Aligning component 150 with feed tube 110 responsive to a visual indicator facilitates proper advancement of component 150 through feed tube 110. According to one example, alignment of component 150 with feed tube 110 is performed automatically by an alignment mechanism, such as an actuator, responsive to the visual indicator.

Referring generally to FIGS. 1, 3, 4, and 6-10, the instant paragraph pertains to example 70 of the present disclosure. According to example 70, which includes the subject matter of example 69, above, the visual indicator is a beam of light.

The visual indicator can be provided by a laser sensor that senses the alignment of component 150 with feed tube 110. The beam of light can be a laser beam. A laser sensor provides feedback regarding the alignment of component 150 with feed tube 110.

Figure 11:
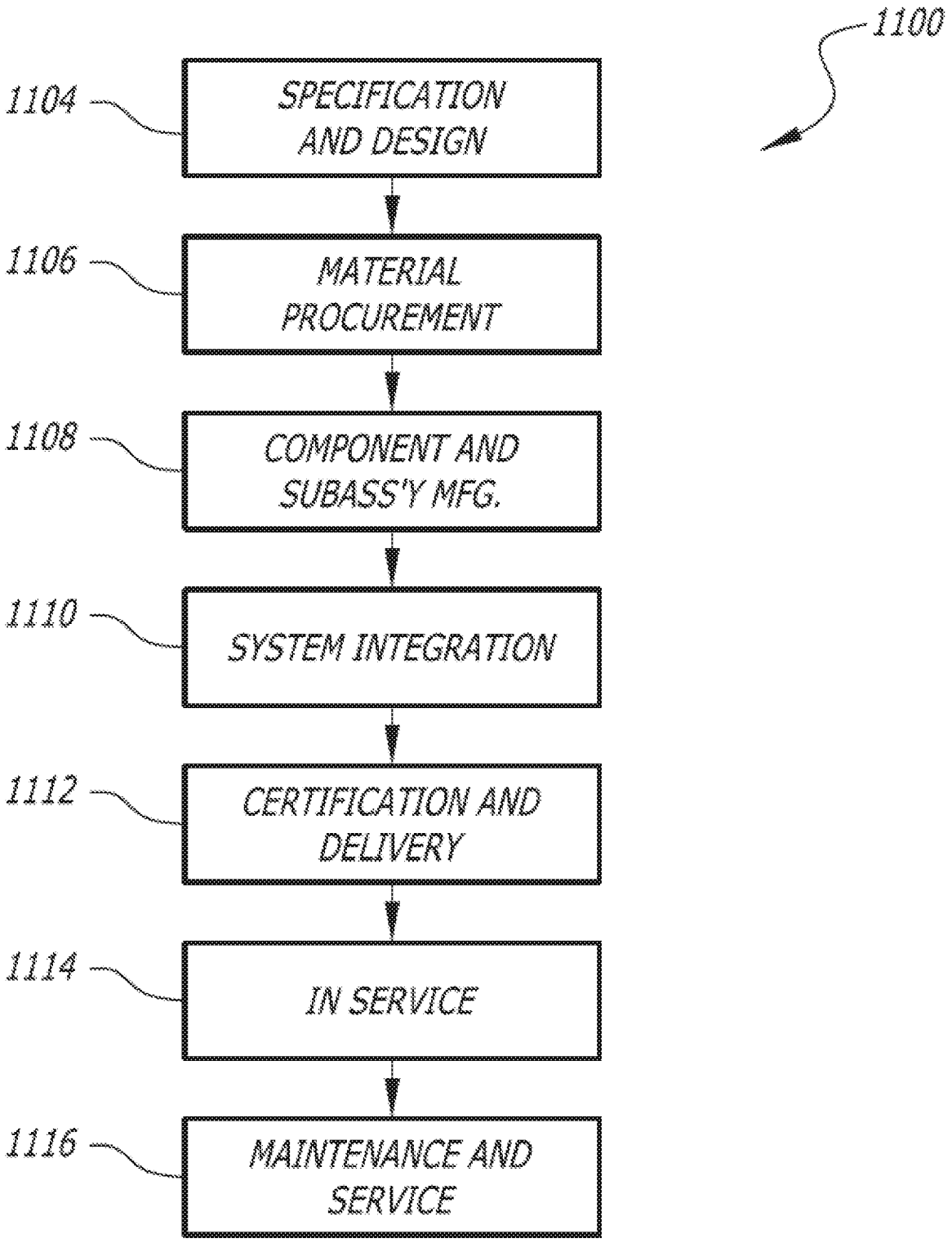
Figure 12:
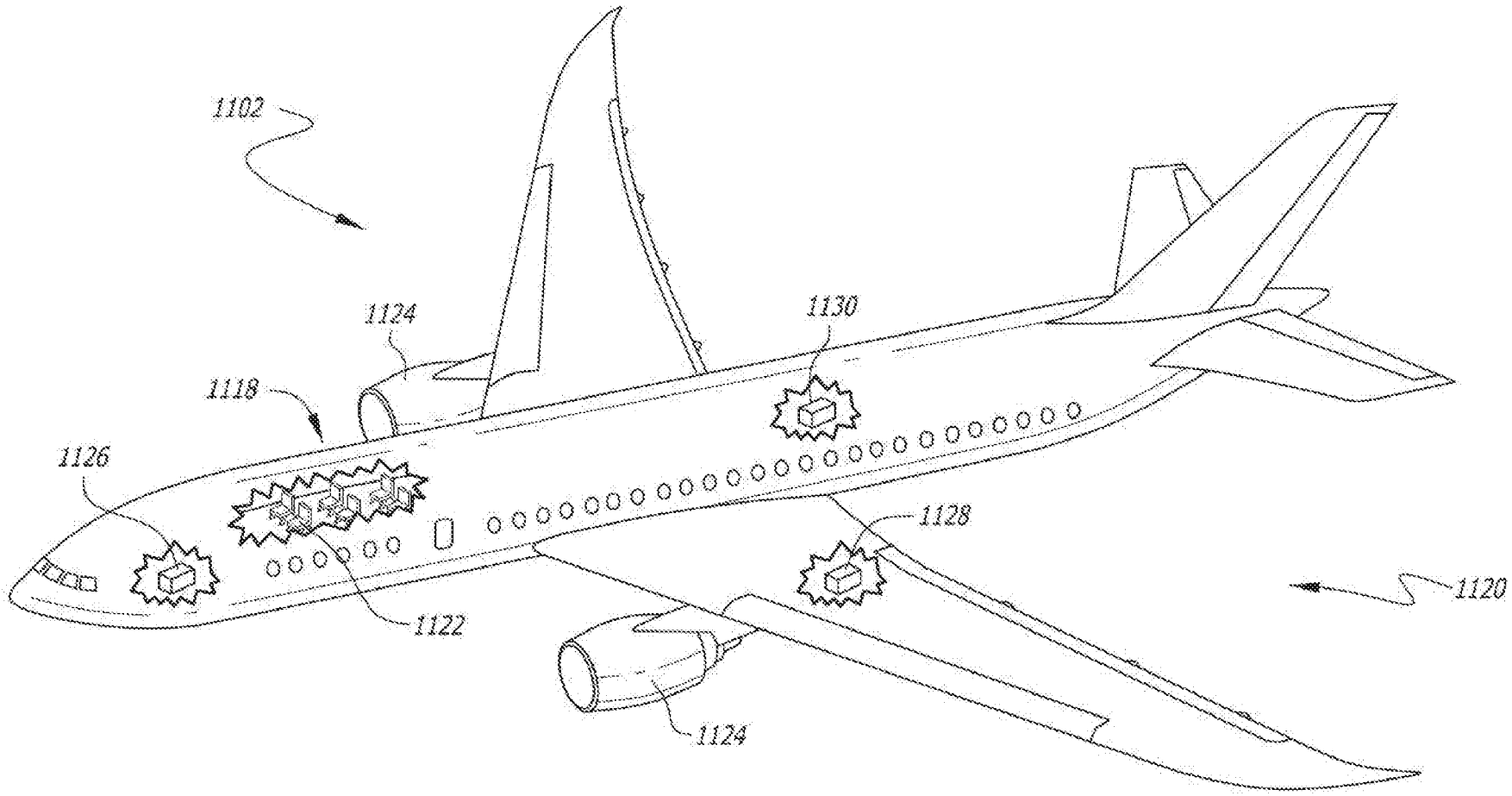

Examples of the present disclosure may be described in the context of aircraft manufacturing and service method 1100 as shown in FIG. 11 and aircraft 1102 as shown in FIG. 12. During pre-production, illustrative method 1100 may include specification and design block 1104 of aircraft 1102 and material procurement block 1106. During production, component and subassembly manufacturing block 1108 and system integration block 1110 of aircraft 1102 may take place. Thereafter, aircraft 1102 may go through certification and delivery block 1112 to be placed in service block 1114. While in service, aircraft 1102 may be scheduled for routine maintenance and service block 1116. Routine maintenance and service may include modification, reconfiguration, refurbishment, etc. of one or more systems of aircraft 1102.

Each of the processes of illustrative method 1100 may be performed or carried out by a system integrator, a third party, and/or an operator e.g., a customer. For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 12, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatuses and methods shown or described herein may be employed during any one or more of the stages of the manufacturing and service method 1100. For example, components or subassemblies corresponding to component and subassembly manufacturing 1108 may be fabricated or manufactured in a manner similar to components or subassemblies produced while aircraft 1102 is in service. Also, one or more examples of the apparatuses, methods, or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service, e.g., maintenance and service stage block 1116.

Different examples of the apparatuses and methods disclosed herein include a variety of components, features, and functionalities. It should be understood that the various examples of the apparatuses and methods disclosed herein may include any of the components, features, and functionalities of any of the other examples of the apparatuses and methods disclosed herein in any combination, and all of such possibilities are intended to be within the spirit and scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. A packaging apparatus, comprising:

a base surface, comprising a first end and a second end;

a feed tube between the first end and the second end of the base surface;

a transporter between the first end of the base surface and the feed tube;

a first sealer between the feed tube and the second end of the base surface; and a second sealer between the first sealer and the second end of the base surface;

wherein the base surface has an angle β with respect to a virtual horizontal plane.

2. The apparatus of claim 1, further comprising a packaging dispenser at the second end.

3. The apparatus of claim 1, wherein the transporter comprises first rollers.

4. The apparatus of claim 3, wherein the transporter further comprises at least one active roller.

5. The apparatus of claim 3, wherein the first rollers are passive rollers.

6. The apparatus of claim 1, wherein the transporter comprises a low-friction surface.

7. The apparatus of claim 1, wherein the transporter comprises an air bearing.

8. The apparatus of claim 1, wherein the angle β is adjustable.

9. The apparatus of claim 1, wherein the first end of the base surface is elevated relative to the second end of the base surface.

10. The apparatus of claim 1, wherein at least a portion of the base surface is tiltable about an axis, parallel to the feed tube.

11. The apparatus of claim 1, further comprising a position sensor, operatively coupled to at least one of the first sealer and the second sealer.

12. The apparatus of claim 1, further comprising a position sensor, operatively coupled to the transporter.

13. The apparatus of claim 12, wherein the position sensor is operatively coupled to at least one of the first sealer and the second sealer.

14. The apparatus of claim 1, wherein the first sealer and the second sealer are separated by a distance D.

15. The apparatus of claim 14, wherein the distance D is adjustable.

16. The apparatus of claim 15, wherein the base surface further comprises a track, and the distance D is adjustable by moving at least one of the first sealer and the second sealer along the track.

17. The apparatus of claim 1, further comprising an end cap, configured to cover a leading end of a component to be packaged.

18. The apparatus of claim 17, wherein the end cap comprises a curved convex leading surface.

19. A packaging system, comprising:

a base surface, comprising a first end and a second end;

a feed tube between the first end and the second end of the base surface;

a transporter between the first end of the base surface and the feed tube;

a first sealer between the feed tube and the second end of the base surface;

a second sealer between the first sealer and the second end of the base surface;

a position sensor between the first sealer and the second sealer; and a robotic arm, operatively coupled with the position sensor;

wherein the base surface has an angle β with respect to a virtual horizontal plane.

20. A packaging apparatus, comprising:

a base surface, comprising a first end and a second end;

a feed tube between the first end and the second end of the base surface;

a transporter between the first end of the base surface and the feed tube;

a first sealer between the feed tube and the second end of the base surface; and a second sealer between the first sealer and the second end of the base surface;

wherein at least a portion of the base surface is tiltable about an axis parallel to the feed tube.

* * * * *